US006223537B1

(12) United States Patent
Lipinski et al.

(10) Patent No.: US 6,223,537 B1
(45) Date of Patent: May 1, 2001

(54) CATALYTIC COMBUSTOR FOR GAS TURBINES

(75) Inventors: John J. Lipinski, Tempe; Philip J. Brine, Gilbert; Rajesh D. Buch, Chandler, all of AZ (US); George R. Lester, Salem, VA (US)

(73) Assignee: AlliedSignal Power Systems, Albuquerque, NM (US)

( * ) Notice: Subject to any disclaimer, the term of this patent is extended or adjusted under 35 U.S.C. 154(b) by 0 days.

(21) Appl. No.: 09/196,556

(22) Filed: Nov. 20, 1998

Related U.S. Application Data

(60) Provisional application No. 60/066,494, filed on Nov. 24, 1997.

(51) Int. Cl.[7] ..... F23R 3/40

(52) U.S. Cl. ..... 60/723; 60/737; 431/7

(58) Field of Search ..... 60/39.06, 723, 60/737, 738; 431/7

(56) References Cited

U.S. PATENT DOCUMENTS

| | | | | |
|---|---|---|---|---|
| 3,846,979 | | 11/1974 | Pfefferle et al. . | |
| 3,943,705 | | 3/1976 | DeCorso et al. | 60/39.74 |
| 4,019,316 | | 4/1977 | Pfefferle | 60/39.02 |
| 4,118,171 | * | 10/1978 | Flanagan et al. | 60/723 X |
| 4,285,193 | | 8/1981 | Shaw et al. . | |
| 5,000,004 | * | 3/1991 | Yamanaka et al. | 60/723 |
| 5,003,768 | | 4/1991 | Kappler . | |
| 5,026,273 | * | 6/1991 | Cornelison | 60/723 X |
| 5,431,017 | | 7/1995 | Kobayashi et al. | 60/723 |
| 5,452,574 | * | 9/1995 | Cowell et al. | 60/39.23 |
| 5,634,784 | | 6/1997 | Pfefferle et al. | 431/7 |
| 5,685,156 | * | 11/1997 | Willis et al. | 60/723 |
| 5,826,429 | | 10/1998 | Beebe et al. | 60/723 |

FOREIGN PATENT DOCUMENTS

| | | | | |
|---|---|---|---|---|
| 1070127 | * | 1/1980 | (CA) | 60/723 |
| 0103159 | * | 3/1984 | (EP) | 60/723 |
| 106659 | * | 4/1984 | (EP) | 60/723 |
| 0356092 A1 | | 2/1990 | (EP) . | |

OTHER PUBLICATIONS

Article: Catalytic Combustion for Gas Turbine Applications; Krill et al.; ASME publication; Jan. 11, 1979; 7 pp.

Article: Performance and Emissions of a Catalytic Reactor with Propane, Diesel and Jet A Fuels, David N. Anderson; Sep. 1977; NASA—Lewis Research Ctr., No.: NASA TM–73786; 13 pp.

Article: Design of a Catalytic Combustor for Heavy–Duty Gas Turbines; Touchton et al.; Journal of Engineering for Power, vol. 105; Oct. 1983; pp. 797–805.

Article: Development and Test of a Catalytic Combustor for an Automotive Gas Turbine; John J. Lipinski et al. ; ASME #98–GT–390; 10 pp.

* cited by examiner

*Primary Examiner*—Ted Kim
(74) *Attorney, Agent, or Firm*—Ephraim Starr; Felix L. Fischer

(57) ABSTRACT

In a catalytic combustor for gas turbines, the dimensions of the preheater and premix duct, the location of the preheater and premix fuel nozzles, and the number and location of air orifices in the combustor can inner liner are configured to result in low NOx production during both preheating combustion and catalytic combustion. Placement of the air orifices helps reduce the potential for autoignition within the premix duct, while enhancing fuel-air mixture uniformity upstream of the catalyst. At the same time, the overall configuration is optimized to result in the relative compactness of the catalytic combustor, making it particularly suitable for applications such as automotive turbine engines and microturbines.

12 Claims, 2 Drawing Sheets

CATALYTIC COMBUSTOR FOR GAS TURBINES

CROSS-REFERENCE TO RELATED APPLICATIONS

This application claims priority from co-pending provisional application Ser. No. 60/066,494, filed Nov. 24, 1997.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

This invention relates generally to combustors for use with gas turbines. More particularly, the invention provides a compact, low emission catalytic combustor for gas turbines operable in automotive and other environments.

Catalytic combustion makes possible extremely low emissions of pollutants from gas-powered turbine generators, particularly of oxides of nitrogen (NOx). A properly designed catalytic combustor can deliver both low NOx and low carbon monoxide (CO) emissions over the full engine operating range, in contrast to conventional combustors which may suffer from high NOx or high CO at different points in the duty cycle. In addition, stability and acoustic problems often associated with alternative low-NOx combustors are avoided with catalytic combustion, as are the complications of variable geometry.

Catalytic combustion is possible only when the combustor inlet temperature exceeds a minimum value that is a function of the catalyst formulation. This is typically about 700 F. Thus, a conventional diffusion-flame preheater is required for engine starting and for accelerating the engine to the speed necessary to obtain an adequate combustor inlet temperature. Once this condition has been reached, the preheater can be shut off. At this point a separate fuel delivery system is used to introduce fuel into the premix duct, where the fuel is evaporated (if liquid rather than gaseous fuel is used) and mixed with the incoming air. The resulting fuel-air mixture is then introduced into the catalyst bed. When liquid fuel is used, complete evaporation of the fuel as well as thorough mixing of air and the fuel must be achieved within the premix duct in order to obtain minimum combustor emissions and to avoid damage to the catalyst bed. Similarly, when gaseous fuel is used, thorough mixing of air and the fuel must be achieved within the premix duct.

Within the catalyst bed, combustion is initiated by catalytic action near the bed walls. Once initiated, combustion is continued by homogeneous combustion in the gas phase. Ignition by the catalyst makes possible complete combustion at very low flame temperatures, which results in extremely low NOx production. Support of the flame by the catalyst also results in high efficiency combustion, which leads to low CO emissions. Thus, both NOx and CO can be kept low over a wide range of engine speeds and loads.

While catalytic combustion is not a new technology, the present invention provides a relatively small-sized catalytic combustor compared to earlier examples of such combustors. For example, in previous catalytic combustor designs, the preheater has typically been designed to be remote from the premix duct. This is because the recirculating flows that are necessary to support diffusion-flame combustion within the preheater cannot be tolerated within the premix duct. At the relatively high combustor inlet temperatures necessary for catalytic operation, autoignition of the fuel within the premix duct is a distinct possibility. Excessively recirculating flows within the premix duct can lead to long residence times for the air-fuel mixtures in the duct and result in a high probability of autoignition. However, autoignition must be avoided in low emission combustion because autoignition can result in high flame temperatures and thus high NOx production. For this reason the preheater has in the past typically been physically separated from the premix duct.

The present invention, in addition to enabling the construction of a relatively small catalytic combustor, also addresses the problem of meeting or exceeding stringent emissions standards. For example, emissions standards for the Ultra-Low Emissions Vehicle (ULEV) specify stringent emission limits over a complete driving cycle from engine startup to shutdown. Thus, the present invention was designed to provide low emissions not only from the catalyst, but also from the preheater during its ignition through the engine spoolup and warmup phases to the transition to catalytic operation.

BRIEF SUMMARY OF THE INVENTION

The invention disclosed herein is a relatively compact catalytic combustor for gas turbines used in such applications as hybrid electric vehicles, compact on-site power generation devices, and other situations where small size is a plus. A design feature that helps make possible the uniquely small size of the present catalytic combustor is the integration of the combustor's preheater and the premix duct. The preheater is grafted onto the inlet of the premix duct, which significantly shortens the overall package and enables use of a low-emission catalytic combustor for applications that, prior to the invention, would have been extremely inconvenient or not possible due to size constraints. Structurally, the combustor has a combustor can, an upstream end, an inner liner, and a chamber. The combustor can surrounds the inner liner and the inner liner surrounds the chamber. The chamber has a preheater portion and a premix duct portion, surrounded by the inner liner. A catalyst bed is located sequentially downstream from the upstream end. The preheater is a type of diffusion-flame burner having at least one preheater fuel nozzle and the premix duct includes a plurality of premix fuel nozzles. The premix duct portion of the inner liner has a diameter that is larger upstream of the premix fuel nozzles than downstream of the premix fuel nozzles. The inner liner further includes a plurality of primary air orifices for introducing air into the preheater portion of the chamber and a plurality of secondary air orifices for introducing air into the chamber downstream of the primary air orifices.

A further aspect of the invention relates to the conflicting requirements of the preheater and premix duct. The preheater, unlike the premix duct, must support a stable flame during its operation. The configuration of the disclosed catalytic combustor satisfies these conflicting requirements of the preheater and premix duct.

BRIEF DESCRIPTION OF THE DRAWINGS

The details and features of the present invention will be more clearly understood with respect to the detailed description and drawings in which.

DETAILED DESCRIPTION OF THE INVENTION

Figure 1:
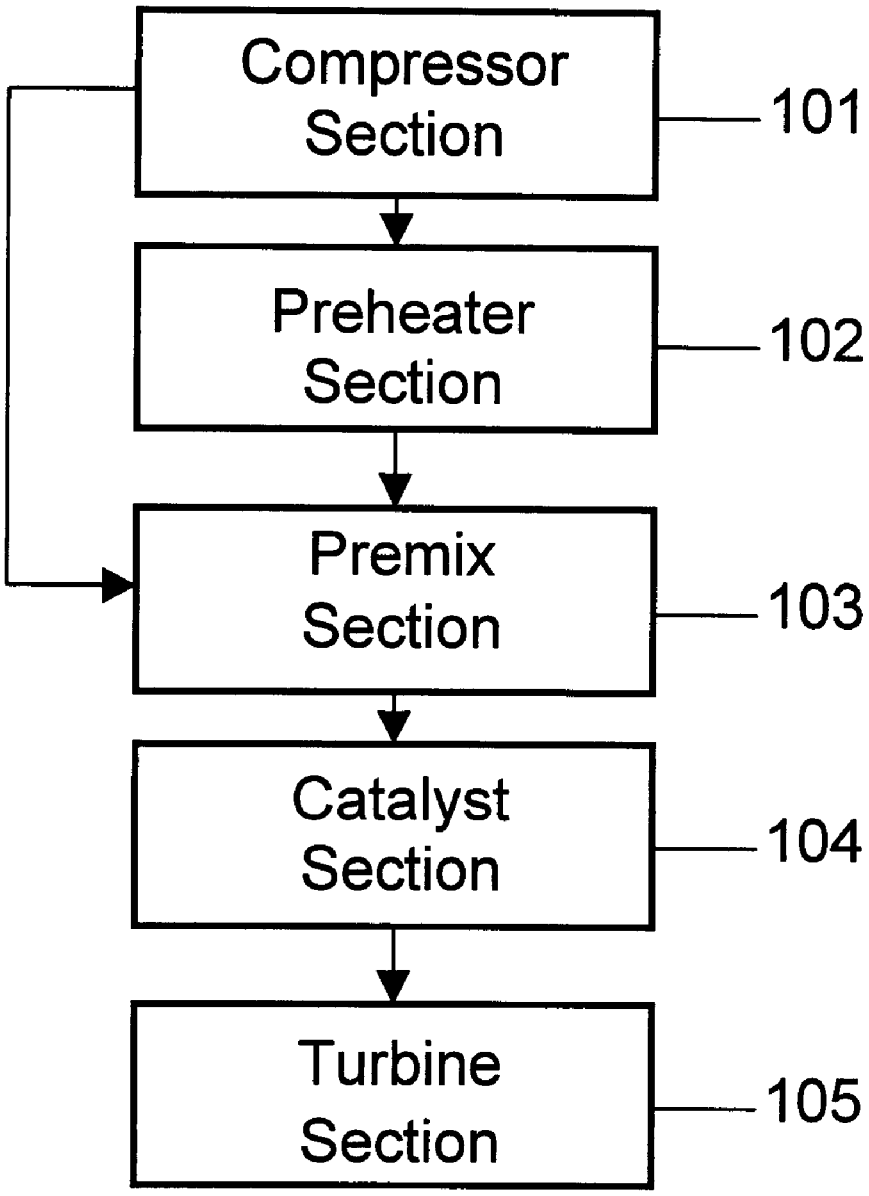
FIG. 1 is a flow chart representing the flow of air through a catalytic combustor employing the present invention.

Referring to the drawings, FIG. 1 represents the basic flow of air into, through, and out of a catalytic combustor employing the present invention. In all operating modes, a portion of compressed air from a compressor section 101 of a gas turbine engine flows in series through a preheater section 102, a premix section 103, a catalyst section 104, and then through a turbine inlet duct and scroll into a turbine section 105. A portion of the compressed air also flows in parallel with the air passing through the preheater section 102 into the premix section 103 without having first gone through the preheater section 102. As used herein, gas turbine engine is intended to be very general, and includes, for instance, gas turbine engines for automotive and other transportation applications and turbine generators and microturbines for distributed power applications. If the gas turbine engine uses a recuperator (not shown), the recuperator is preferably located upstream of the compressor section 101, although, as explained herein, some of the air flow can be directed to bypass the recuperator to keep the temperature of the air relatively low.

Figure 2:
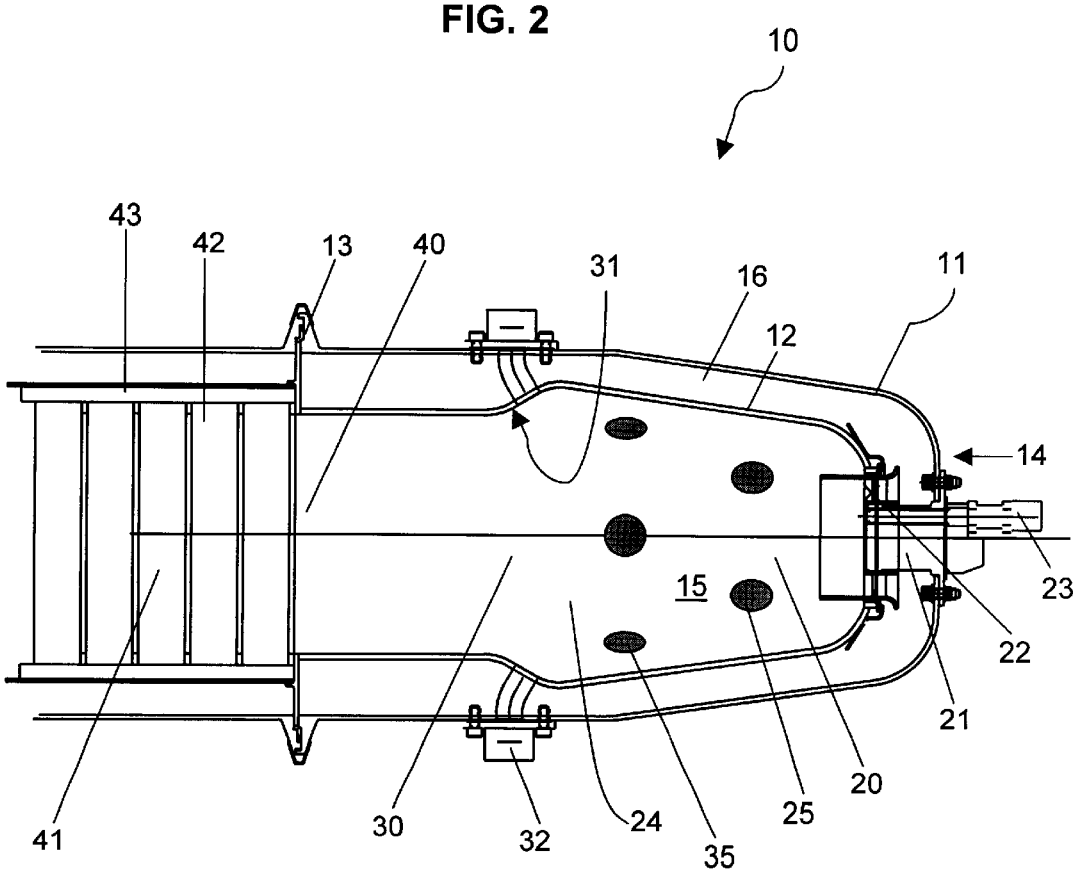
FIG. 2 is a side view of a catalytic combustor constructed in accordance with the present invention.

For the embodiment shown in the drawings, the combustor configuration is optimized with respect to several parameters. Referring to FIG. 2, these parameters include the overall lengths and diameters of the preheater 20 and premix duct 30, the location and flow or spray characteristics of premix fuel nozzles 32, and the number and location of secondary air orifices 35 located in the premix duct liner 31. Packaging constraints, which are commonly associated with the design of a catalytic combustor for use in automotive and other applications in which small size is desirable, were also considered in optimizing the combustor dimensions. Use of a three-dimensional elliptic finite-difference computational fluid dynamics (CFD) code was made in the optimization of the combustor configuration in the embodiment shown in the drawings. For a preferred embodiment using liquid fuel, a spray evaporation subroutine was included in the CFD code to help determine the degree of fuel evaporation that would obtain at the catalyst inlet 40 for various configurations. Published diesel fuel autoignition delay time test data was curve fit and used to estimate the potential for autoignition based on local conditions. This published test data can be found in TeVelde, J. A., and Spadaccini, L. J., 1981, "Autoignition Characteristics of No. 2 Diesel Fuel," NASA CR-165315, and Lefebvre, A. H., Freeman, W., and Cowell, L., 1986, "Spontaneous Ignition Delay Characteristics of Hydrocarbon Fuel/Air Mixtures," NASA CR-175064. The autoignition potential was minimized throughout the calculation domain, while at the catalyst inlet 40 fuel evaporation was maximized and fuel-air mixture non-uniformity was minimized.

The following is a general description of the combustor configuration:

The combustor 10 has a generally double-walled, can-shaped configuration. The combustor 10 includes a combustor can 11, an inner liner 12 and an upstream end 14. As used herein, the phrase combustor can refers to a generally cylindrical-shaped combustor housing as opposed to an annular combustor housing; the phrase is not limited to a perfect right cylinder, but includes variations on the cylindrical housing such as where one or both liners have diameters that vary along the axial direction. The combustor can 11 surrounds the inner liner 12, and the inner liner 12 surrounds the chamber 15. As used herein, surrounds and surrounding mean generally disposed around, and do not imply that one structure or space completely encompasses another, nor do they imply that one structure is necessarily in physical contact with another. For instance, while the inner liner 12 surrounds the chamber 15, the inner liner 12 is open at its downstream end. Similarly, while the combustor can 11 is surrounding the inner liner 12, in the preferred embodiment, the combustor can 11 and inner liner 12 do not contact one another but rather define a channel 16 through which air from a compressor section 101 flows before entering the chamber 15. In the embodiment shown in the drawings, the inner liner 12 is supported within the combustor can 11 by a perforated flange 13. The inner liner 12 may also be supportably attached to fuel nozzles, preferably in a loose-fitting manner to allow for thermal expansion.

Moving sequentially downstream from the preheater 20, the combustor 10 includes a premix duct 30, a catalyst inlet 40, and a catalyst bed 41. In the embodiment shown in the drawings, at its downstream end, the inner liner 12 is approximately adjacent the upstream end of the catalyst bed 41, and the supporting structure for the catalyst bed 41 is engaged by the flange 13 for coaxial alignment with the inner liner 12. The catalyst bed 41 opens into a turbine section 105, which typically includes a turbine inlet and turbine wheel (not shown). In an alternative embodiment, the catalyst bed 12 is not in coaxial alignment with the inner liner 12, but is angled with respect to the axis of the inner liner 12 as may be appropriate for a given application.

The preheater 20 is a type of diffusion-flame burner that is preferably of conventional construction, utilizing at least one preheater fuel nozzle 21 surrounded by one or more air swirlers 22 that serve to introduce air and stabilize the flame when the combustor is operating in a preheater mode. In the best mode of practicing the present invention, a single preheater fuel nozzle is used and is positioned parallel to an axis of the combustor, extending from the upstream end 14, and has its outlet surrounded by an axial air swirler. When liquid fuel is used, the at least one preheater fuel nozzle is preferably of the pressure or airblast type. The preheater also includes an igniter 23 for igniting the air and fuel that is to be combusted. In alternative embodiments, spark plugs, glow plugs, torches or other means for igniting a diffusion flame burner are employed in place of the igniter 23.

The combustor 10 also includes a plurality of primary air orifices 25 and a plurality of secondary air orifices 35 in the inner liner 12 downstream of the preheater fuel nozzle 21 and air swirlers 22. The primary air orifices 25 introduce additional air into the preheater 20 to enhance combustion in the preheater mode of operation. In a preferred embodiment, there are six primary air orifices circumferentially spaced around the inner liner 12. The air entering the preheater 20 through the primary air orifices 25 further stabilizes the flame by recirculating towards the preheater fuel nozzle 21, while also diluting the reacting fuel-air mixture to a level appropriate for relatively low NOx and soot production.

Downstream of the primary air orifices 25, a plurality of secondary air orifices 35 further reduces the reaction temperature and provides mixing of the fuel-air charge. It is desirable that the temperature reduction and the mixing of the fuel-air charge are sufficient to prevent damage to the catalyst and to minimize wear on the catalyst during preheater operation. In a preferred embodiment, there are twelve secondary air orifices spaced circumferentially around the inner liner 12, and the secondary orifices have a generally racetrack shape with the longer dimension oriented parallel to the axis of the inner liner 12.

The portion of the combustor that is generally located between the preheater 20 and the catalyst inlet 40 comprises the premix duct 30. It is important to note that there is no set boundary between the premix duct 30 and the preheater 20, and, in operation, some preheating of air and fuel extends into the premix duct 30 while some premixing of air and fuel extends slightly into the preheater 20. However, a radial plane located just upstream of the secondary air orifices 35 generally defines the upstream end of the premix duct 30.

In the embodiment shown in the drawings, the following approximate dimensions are employed:

Preheater 20, measured from the upstream end of the combustor can 11 to a radial plane located just upstream of the secondary air orifices 35: 5.25 inches.

Premix duct 30, measured from the radial plane located just upstream of the secondary air orifices 35 to the downstream end of the inner liner 12: 8.6 inches.

Inner diameter of the combustor can 11, measured downstream of the premix fuel nozzles 32: 8.0 inches.

Inner diameter of the inner liner 12, measured at its widest point upstream of the premix fuel nozzles 32: 6.6 inches.

Inner diameter of the inner liner 12, measured downstream of the premix fuel nozzles 32: 5.4 inches.

Diameter of the primary air orifices 25: 0.94 inches.

Length of secondary air orifices 35, measured parallel to the axis of inner liner 12: 1.17 inches.

Width of secondary air orifices 35, measured perpendicular to the axis of inner liner 12: 0.39 inches.

During preheater operation, the premix duct 30 serves merely as an extension of the dilution zone 24 of the preheater 20. However, roughly when a high enough combustor inlet temperature is reached that efficient catalytic operation can commence, the preheater fuel flow is discontinued and fuel flow is introduced into one or more premix fuel nozzles 32.

In premix operation, the premix fuel nozzles 32 installed in the combustor's inner liner 12 in the premix duct 30 are used to inject fuel into the airflow upstream of the catalyst bed 41. The diameter of the premix duct liner 31 is preferably larger upstream of the premix fuel nozzles 32 than it is downstream of the premix fuel nozzles 32.

In a preferred embodiment, three premix fuel nozzles are used and no additional fuel is injected downstream of the catalyst bed 41. Furthermore, the premix fuel nozzles 32 are preferably smaller than the preheater fuel nozzle 21. When the combustor is operated with a liquid fuel such as diesel, the three premix fuel nozzles 32 are arranged equally spaced around the circumference of the premix duct 30. In the best mode, the premix fuel nozzles 32 should be angled upstream about 30 degrees from the radial direction, which gives liquid fuel sufficient time to evaporate and mix in the volume located between the secondary air orifices 35 and the premix fuel nozzles 32, yet without allowing enough residence time for autoignition to occur. The larger diameter of the premix duct liner 31 upstream of the premix fuel nozzles 32 provides sufficient volume for evaporation and mixing, while the smaller diameter downstream of the premix fuel nozzles 32 enables higher velocities for avoidance of autoignition and straightening of the flow for presentation to the catalyst inlet 40. Gaseous fuel may also be used in a combustor constructed in accordance with this preferred embodiment, as the arrangement described provides for adequate mixing of gaseous fuel and air, even though evaporation of gaseous fuel is not necessary.

The resulting combustor configuration helps to prevent recirculating flows within the preheater 20 from entering the premix duct 30. The secondary air orifices 35 cut into the premix duct liner 31 are a design feature that helps the combustor to perform in this manner. These secondary air orifices 35 serve two functions. First, during preheater operation, they function as dilution jets in a conventional combustor. That is, a high-temperature diffusion flame is supported within the preheater 20, and the secondary air orifices 35 act as dilution jets to introduce additional air into the flow to reduce the temperature to a level low enough to be acceptable to the catalyst bed 41 and the downstream turbine section 105. In this operating mode, the premix duct 30 thus acts as the dilution zone in a conventional combustor. At about the same time that the preheater 20 is shut off, fuel is introduced into the premix duct 30 through the premix fuel nozzles 32. In this mode, the secondary air orifices 35 serve not only to mix the fuel with the incoming air, but also form a curtain of air to shield the fuel-air mixture within the premix duct 30 from the recirculating flows that exist within the preheater 20. In this way, a well mixed, relatively uniform fuel-air mixture is delivered to the catalyst bed 41, and autoignition within the premix duct 30 is avoided.

For liquid-fuel embodiments, the premix fuel nozzles 32 and preheater fuel nozzle 21 are preferably of the simplex airblast design, which provides both low cost and ability to withstand high temperatures at the combustor inlet. In applications in which a recuperator is used (both upstream and downstream of the combustor 10), the premix fuel nozzles 32 and preheater fuel nozzle 21 are preferably supplied with relatively cool airblast air arriving directly from the compressor section 101, without having passed through the recuperator. Thus, during engine operation, the temperature of the premix fuel nozzles 32 and preheater fuel nozzle 21 can be kept at a desirable, relatively low temperature. However, after engine shutdown, soakback of engine heat into the premix fuel nozzles 32 and preheater fuel nozzle 21 can present problems with thermal degradation of fuel left in the nozzles. Therefore, in a preferred embodiment of the present invention, a means for purging fuel left in the nozzles upon or after engine shutdown is recommended. Fuel valves that include such a purging means are commercially available. For instance, the Woodward Governor Company located in Walnut Creek, Calif. manufactures a fuel valve called the Eco Valve, which is suitable for this application.

The catalyst bed 41 may be in the form of one or more ceramic discs 42 arranged in series. These discs may be comprised of, for example, a square-channel ceramic honeycomb substrate of Corning EX-22, which is known for its durability, high strength, and low-pressure drop. This substrate is a commercial product used in industrial catalytic processes and is similar to that commonly used in automotive exhaust catalysts, which facilitates low cost and availability of the substrate. The substrate should be coated with a catalyst formulation suitable for catalysis of the fuel to be used in a given application. The catalyst discs 42 may be retained in place by one of many retaining means. It is preferable to retain the catalyst discs 42 in place by compressing a mat of fibers, such as alumina/silica fibers, between the discs and a catalyst bed liner 43. This containment means is similar to standard automotive practice.

The cycle air passes through the catalyst bed 41; hence, in a preferred embodiment in which no fuel is introduced downstream of the catalyst bed 41, the catalyst operating temperature is the same as the turbine inlet temperature (except for a minor difference due to CO and HC burnout in the turbine inlet duct). In an alternative embodiment, an additional combustion stage may be employed downstream of the catalyst bed 41 to increase power. Such an additional combustion stage, however, will increase the turbine inlet temperature to levels that shorten the useful life of components in the turbine section 105 unless a more expensive, cooled turbine section 105 is used. Therefore, no additional combustion stage is employed in the preferred embodiment.

When low manufacturing cost for volume production is an important design consideration, stainless steel rather than superalloy may be used for all major combustor components in the present invention. Further, thermal barrier coatings or active cooling schemes do not have to be used with the present invention. Also, a standard industrial catalyst substrate may be used, as well as conventional-design low-cost gas turbine fuel nozzles. If used in an automotive application, the combustor of the present invention may be packaged together with the rest of the engine hardware, electronics, and drive system to fit in the engine compartment of an existing mid-size car.

There are alternative embodiments to the embodiment of the present invention as shown in the drawings. For instance, in one alternative embodiment, the axial swirler in the diffusion-flame burner is not used, and a radial swirler is employed instead. Or, no swirler is used, and opposing-flow jets are used instead. In another embodiment, more than one preheater fuel nozzle is used. In still another embodiment, the igniter is not positioned coaxial with the axis of the combustor, but is offset at an angle. In yet another embodiment, the diameter of the inner liner does not vary from its upstream end to its downstream end, but remains approximately constant.

The invention now having been described in detail, those skilled in the art may recognize modifications and substitutions to the specific embodiments disclosed herein. Such modifications and substitutions are within the scope and intent of the present invention, as set forth in the following claims.

What is claimed is:

1. A catalytic combustor for gas turbines comprising:

a combustor can having an upstream end, an inner liner, a chamber, and a catalyst bed located downstream from the chamber, the combustor can surrounding the inner liner and the inner liner surrounding the chamber, and the chamber including a preheater and a premix duct; wherein at least one preheater fuel nozzle introduces fuel into the preheater;

a plurality of premix fuel nozzles introduces fuel into the premix duct; and the inner liner includes a plurality of primary air orifices for introducing air into the preheater and a plurality of secondary air orifices for introducing air into the premix duct downstream of the primary air orifices;

each of the plurality of premix fuel nozzles is located downstream of the secondary air orifices;

the inner liner of the premix duct has a diameter that is larger upstream of the premix fuel nozzles than downstream of the premix fuel nozzles; and each of the plurality of premix fuel nozzles is angled upstream about 30 degrees from the radial direction.

2. A catalytic combustor according to claim 1 wherein the at least one premix fuel nozzle comprises a single preheater fuel nozzle, and further comprising an air swirler surrounding the preheater fuel nozzle.

3. A catalytic combustor according to claim 2 wherein the plurality of premix fuel nozzles comprises three premix fuel nobles.

4. A catalytic combustor according to claim 3 wherein the single preheater fuel nozzle is positioned in an axial direction from the upstream end of the combustor.

5. A catalytic combustor according to claim 4 wherein the air swirler is an axial air swirler.

6. A catalytic combustor according to claim 5 wherein the three premix fuel nozzles and single preheater fuel nozzle are each adapted to spray liquid fuel into the chamber.

7. A catalytic combustor comprising:

a substantially cylindrical combustor can having a closed upstream end;

an inner liner supported within the combustor can having a preheater portion with a first end proximate the upstream end of the combustor can, the preheater portion of a frustoconical shape expanding from the first end and including a first plurality of primary air orifices proximate said first end for introducing air into the preheater portion and a second plurality of secondary air orifices distal said first end for introducing combustion air;

a premix portion extending from said preheater portion, said premix portion of frustoconical shape contracting from a first diameter adjacent the preheater portion to a smaller diameter;

a catalyst bed extending from the premix portion of the inner liner;

a plurality of premix nozzles extending through the combustor can and the premix portion of the inner liner intermediate said first and smaller diameters;

at least one preheater fuel nozzle extending through the upstream end of the combustor can into the preheater portion of the inner liner for a diffusion burner; and igniter means for the diffusion burner.

8. A catalytic combustor as defined in claim 7 wherein the premix portion of the inner liner further extends in a substantially cylindrical shape having the smaller diameter.

9. A catalytic combustor as defined in claim 8, further comprising at least one preheater swirler in the first end of the preheater portion of the inner liner.

10. A catalytic combustor for gas turbines comprising:

a combustor can having an upstream end, an inner liner, a chamber, and a catalyst bed located downstream from the chamber, the combustor can surrounding the inner liner and the inner liner surrounding the chamber, and the chamber including a preheater and a premix duct; wherein at least one preheater fuel nozzle introduces fuel into the preheater;

a plurality of premix fuel nozzles introduces fuel into the premix duct;

the inner liner includes a plurality of primary air orifices for introducing air into the preheater and a plurality of secondary air orifices for introducing air into the premix duct downstream of the primary air orifices;

each of the plurality of premix fuel nozzles is located downstream of the secondary air orifices;

the inner liner of the premix duct has a first diameter and a second diameter, the first diameter being larger than the second diameter, the first diameter being upstream of the premix fuel nozzles and the second diameter being downstream of the premix fuel nozzles;

said inner liner continuously contracts from said first diameter to said second diameter; and said premix fuel nozzles are located between said first diameter and said second diameter.

11. A catalytic combustor according to claim 10 wherein each of the plurality of premix fuel nozzles is angled upstream from the radial direction.

12. A catalytic combustor according to claim 11 wherein each of the plurality of premix fuel nozzles is angled upstream about 30 degrees from the radial direction.

* * * * *

UNITED STATES PATENT AND TRADEMARK OFFICE

CERTIFICATE OF CORRECTION

PATENT NO. : 6,223,537 B1 
DATED : May 1, 2001
INVENTOR(S) : John J. Lipinski, Philip J. Brine, Rajesh D. Buch, and George R. Lester It is certified that error appears in the above-identified patent and that said Letters Patent is hereby corrected as shown below:

Column 7, claim 3,
Lines 66 and 67, replace "nobles" with -- nozzles --.

Signed and Sealed this

Eighth Day of January, 2002

*Attest:*

*Attesting Officer*

JAMES E. ROGAN
*Director of the United States Patent and Trademark Office*